United States Patent [19]

Albury

[11] Patent Number: 4,480,645

[45] Date of Patent: Nov. 6, 1984

[54] SMOKING DEVICE

[76] Inventor: Randolph Albury, P.O. Box N. 7512, Nassau, The Bahamas

[21] Appl. No.: 443,648

[22] Filed: Feb. 25, 1983

[51] Int. Cl.[3] ..... A24F 13/02

[52] U.S. Cl. ..... 131/187; 131/215 B; 131/223

[58] Field of Search ..... 131/213, 329, 215 A, 131/187, 215 R, 270, 191, 273, 215 B, 223, 218; 73/23; 128/207.16, 202.21

[56] References Cited

U.S. PATENT DOCUMENTS

| | | | |
|---|---|---|---|
| 3,685,522 | 8/1972 | Kleinhans | 131/223 |
| 4,369,798 | 1/1983 | Jackson | 131/215 B |

FOREIGN PATENT DOCUMENTS

| | | | |
|---|---|---|---|
| 438009 | of 1912 | France | 131/223 |
| 1079291 | 11/1954 | France | 131/215 B |
| 16807 | 8/1891 | United Kingdom | 131/215 B |
| 19132 | 8/1910 | United Kingdom | 131/215 B |

*Primary Examiner*—V. Millin
*Assistant Examiner*—Harry Macey
*Attorney, Agent, or Firm*—John C. Malloy

[57] ABSTRACT

A smoking device composed of a tubular body having a one-way valve between an inlet and an outlet which is adapted to permit smoke to flow from the inlet to the outlet and wherein ports are provided between the one-way valve and the outlet so that when smoke is expelled through the device it will pass through the ports and down tubular lengths which are provided and connected in fluid communication with the ports and each of which contains a one-way valve to permit exhaust of the smoke.

3 Claims, 3 Drawing Figures

SMOKING DEVICE

FIELD OF THE INVENTION

This invention relates to smoker's devices.

BACKGROUND OF THE INVENTION

In the past there have been numerous types of smoker's devices. This invention is of a smoker's device for use in smoking cigarettes.

OBJECTS OF THE INVENTION

It has as an object the provision of a tubular body with a one-way valve which permits smoke from the cigarette in the inlet of the tubular body to pass through the one-way valve to the outlet but which does not permit reverse flow. Reverse flow can take place through exhaust ports to which there is connected in fluid connection tubular lengths extending away from the ports and through which the smoke exhausts through a one-way valve which permits fluid flow from the inlet to the outlet and through the outlet through the tubular lengths by valving structure which does not permit a reverse flow.

It is another object of this invention to provide a device of the type described which is simple and inexpensive to manufacture and well adapted for the purposes for which it is intended.

DESCRIPTION OF THE PREFERRED EMBODIMENT

Figure 1:
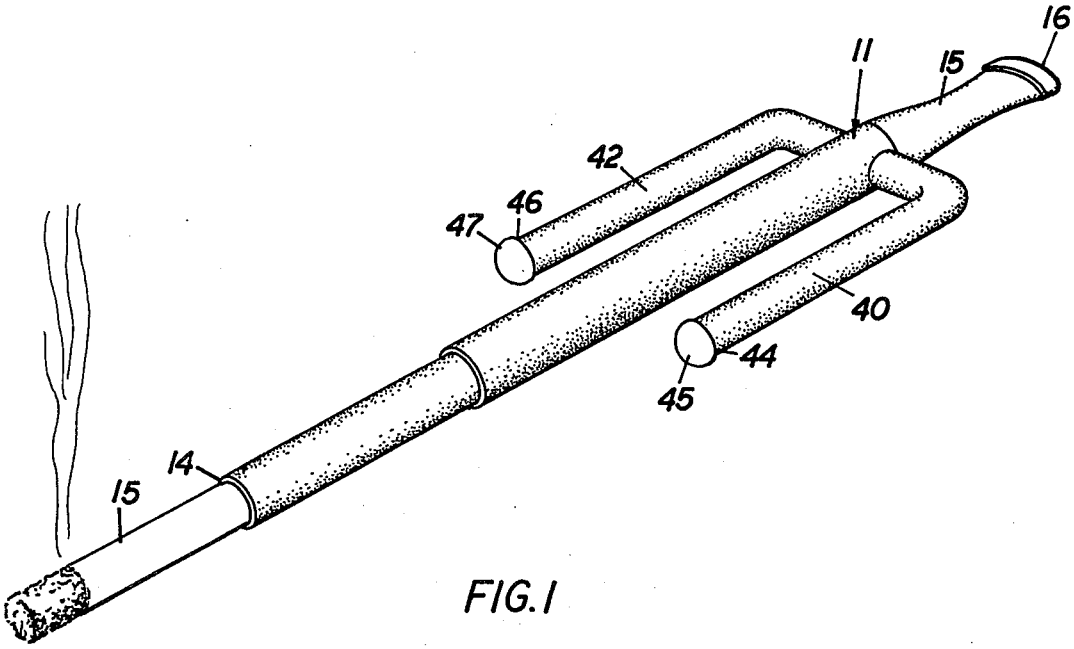
FIG. 1 is a perspective view of the smoking device.
Figure 2:
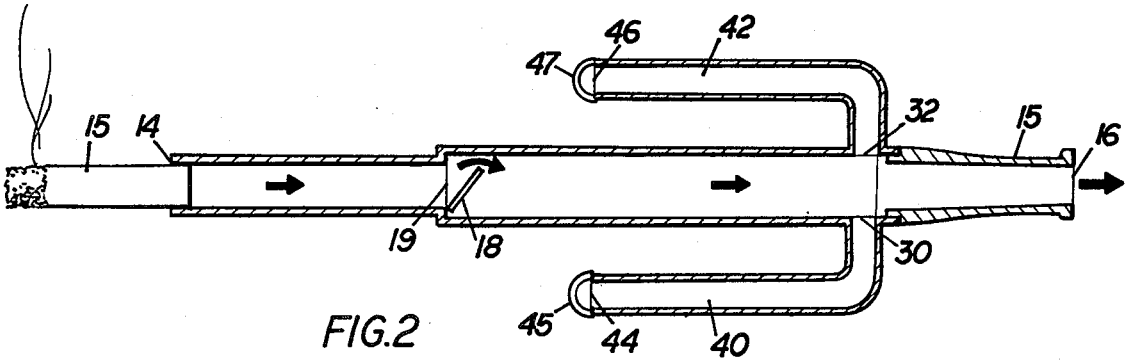
FIG. 2 is a top cross-sectional plan view of the device showing the passage of smoke as it is inhaled through said device.
Figure 3:
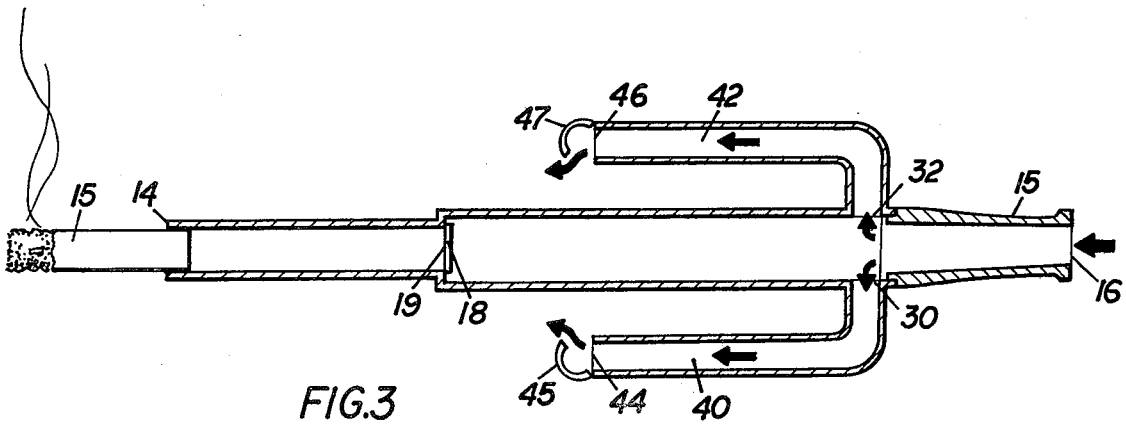
FIG. 3 is a top cross-sectional plan view of the device showing the passage of the smoke as it is expelled through said device.

Referring to the drawings wherein like reference characters designate like or corresponding parts throughout the several views and referring particularly to FIG. 1, there is shown a tubular body 11 having an inlet end 14 and an outlet end 16. There is a one-way valve 18 disposed adjcent the inlet end to open and close part 19. The inlet 14 is sized to nest a cigarette therein in fluid communication and the one-way valve 18 is adapted to permit fluid flow from the inlet 14 to the outlet 16. In the wall of the tubular body there are a pair of oppositely disposed ports 30 and 32. These ports each connect to a length 40 and 42 respectively which terminate at ends 44 and 46 respectively. At each end 44 and 46 there is also provided a one-way valve means 45 and 47 which is adapted to permit fluid flow only in the direction from the outlet 16 through the ports 30 and 32 to exit through the second mentioned one-way valve means 45 and 47 respectively.

In this manner a cigarette may be positioned in the inlet and smoke drawn through the device opening the first mentioned one-way valve 14 and passing through the outlet 16. The smoke may be exhausted by blowing through the outlet 16 which will exit through the ports 30 and 32 and respective tubular lengths and one-way valves arranged thereon. The smoke is not permitted to flow back to the inlet 14 by reason of the one-way valve means 18 closing port 19.

It is thus seen that there has been provided a novel and not obvious smoker's device which is useful in smoking and training one to not smoke cigarettes by providing means for minimal inhalation by efficient exhausting structure built directly into the subject device.

What is claimed is:

1. A smoking device comprising:

(a) a tubular body having an elongated configuration and being substantially hollow along the length of the interior thereof, an inlet formed at one end thereof and being sized to receive a cigarette in nested relation therein, (b) an outlet formed in an opposite end of said tubular body relative to said inlet and in fluid communication therewith along said hollow interior, (c) a first one-way valve disposed within said hollow interior between said inlet and said outlet and structured to regulate fluid flow in one direction, from said inlet to said outlet, (d) a first port and a second port formed in said tubular body in spaced apart and substantially adjacent relation to one another along the length of said hollow interior between said first one-way valve and said outlet, (e) a first and a second tubular length extending outwardly from said tubular body, each having a hollow interior disposed in fluid communication with said hollow interior of said tubular body via said respective ports, (f) a second and a third one-way valve formed within said hollow interior of said first and said second tubular length respectively and each being structured to regulate fluid flow in a single direction from said outlet to the exterior of said device through each of said tubular lengths via said respective ports, and (g) whereby smoke drawn into said inlet is directed to said outlet and smoke exhaled into said device from said outlet is directed through said tubular lengths to the exterior of said device.

2. A smoking device as in claim 1 wherein each of said tubular lengths comprises a substantially straight line fluid path of travel along a majority of said respective tubular length hollow interiors, said substantially straight line fluid paths being disposed in substantially parallel, substantially spaced apart relation to one another and said tubular body.

3. A smoking device as in claim 2 wherein said second and said third one-way valves are disposed contiguous one end of said first and said second tubular lengths respectively; said first, second and third one-way valves cooperatively disposed and structured to regulate fluid flow in said hollow interior of said tubular body and said hollow interior of said tubular lengths from said inlet and said outlet respectively.

* * * * *